US006826995B2

(12) United States Patent
Kazyaka et al.

(10) Patent No.: US 6,826,995 B2
(45) Date of Patent: Dec. 7, 2004

(54) NOISE ABATEMENT SYSTEM FOR A GUN

(75) Inventors: Raymond P. Kazyaka, Greenfield Center, NY (US); Raymond J. Kazyaka, Scotia, NY (US)

(73) Assignee: Wright-Malta Corporation, Malta, NY (US)

( * ) Notice: Subject to any disclaimer, the term of this patent is extended or adjusted under 35 U.S.C. 154(b) by 0 days.

(21) Appl. No.: 10/472,570

(22) PCT Filed: Apr. 18, 2002

(86) PCT No.: PCT/US02/12133

§ 371 (c)(1),
(2), (4) Date: Sep. 24, 2003

(87) PCT Pub. No.: WO02/086409

PCT Pub. Date: Oct. 31, 2002

(65) Prior Publication Data

US 2004/0129131 A1 Jul. 8, 2004

Related U.S. Application Data

(60) Provisional application No. 60/285,220, filed on Apr. 19, 2001.

(51) Int. Cl.[7] ..... F41A 21/30
(52) U.S. Cl. ..... 89/14.4; 89/14.5
(58) Field of Search ..... 89/14.4, 14.5

(56) References Cited

U.S. PATENT DOCUMENTS 1,084,883 A 1/1914 Holzwarth
1,497,553 A * 6/1924 Dickman ..... 181/239
1,990,837 A 2/1935 Morgenstern
4,392,412 A * 7/1983 Schmidt et al. ..... 89/14.4
5,398,589 A 3/1995 Kazyaka et al.
5,461,962 A 10/1995 Krumm et al.
5,610,360 A 3/1997 Kazyaka et al.
5,686,688 A 11/1997 Kazyaka et al.

FOREIGN PATENT DOCUMENTS

GB 0012112 * of 1910

* cited by examiner

*Primary Examiner*—Jack Keith
*Assistant Examiner*—Troy Chambers
(74) *Attorney, Agent, or Firm*—RatnerPrestia

(57) ABSTRACT

A noise abatement apparatus for a gun having a gun tube includes a plurality of generally spherical pressure vessels, with a first pressure vessel having an end adapted to be coupled to the gun tube. The pressure vessels are adapted for attenuating pressure waves caused by a firing of a projectile by the gun and for being mounted on a surface. At least two of the pressure vessels are in general alignment with one another. The apparatus may further include at least one connecting portion, a catcher for entrapping particulates and for permitting the projectile to pass, and at least one orifice plate or baffle for aiding in attenuating the sound. A noise abatement system includes the apparatus and a platform on which the apparatus is mounted. The system may further include an actuator for moving the apparatus along a track that is in physical communication with the platform.

30 Claims, 5 Drawing Sheets

NOISE ABATEMENT SYSTEM FOR A GUN

This application is the U.S. National Phase application of International Application No. PCT/US02/12133, which claims priority of U.S. Provisional Application No. 60/285,220 filed Apr. 19, 2001.

FIELD OF THE INVENTION

The present invention relates to an apparatus and a system for minimizing the noise generated by the firing of a gun.

BACKGROUND OF THE INVENTION

Due to the increased population in the world, the noise generated by the testing of guns in communities located near testing facilities of weapon systems is becoming an increasing problem. As a result of this concern, there has been a need for a gun muffler or system for attenuating the generated noise level. Preferably, such a system should be able to rapidly and safely attenuate the noise generated by the firing of a projectile by a gun.

SUMMARY OF THE INVENTION

The present invention is directed to a noise abatement apparatus for a gun having a gun tube. The apparatus includes a plurality of generally spherical pressure vessels adapted for attenuating pressure waves caused by a firing of a projectile by the gun and for being mounted on a surface. A first of the pressure vessels has an end adapted to be coupled to the gun tube. At least two of the pressure vessels are in general alignment with one another.

The apparatus may further include at least one connecting portion for connecting a pair of the pressure vessels, a catcher disposed within the pressure vessels for entrapping particulates and for permitting the projectile to pass, at least one orifice plate or baffle disposed in at least one of the pressure vessels for aiding in attenuating the sound generated by the firing of the gun, and a plurality of rods attached to an end of the orifice plate.

According to a noise abatement system of the present invention, the system includes the apparatus 20, as described above, adapted for being mounted on a platform. The system may further include an actuator, which can be used to move the apparatus along a track that is mounted on the platform.

BRIEF DESCRIPTION OF THE DRAWINGS

The invention is best understood from the following detailed description when read in connection with the accompanying drawings, in which.

DETAILED DESCRIPTION OF THE INVENTION

Figure 1:
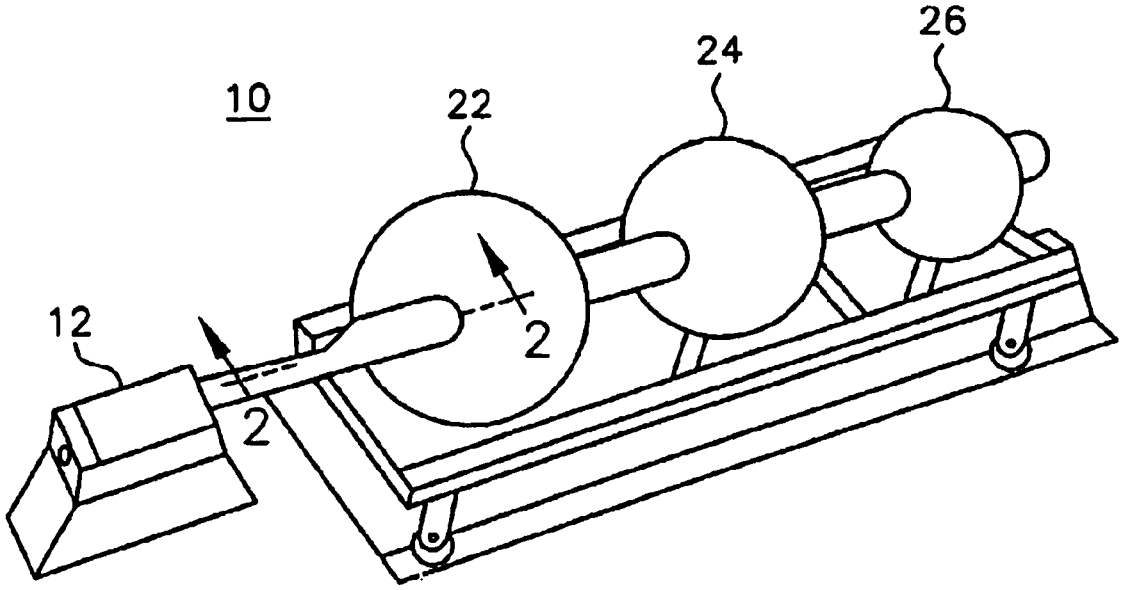
FIG. 1 is a perspective view of an embodiment of a noise abatement system of the present invention.
Figure 2:
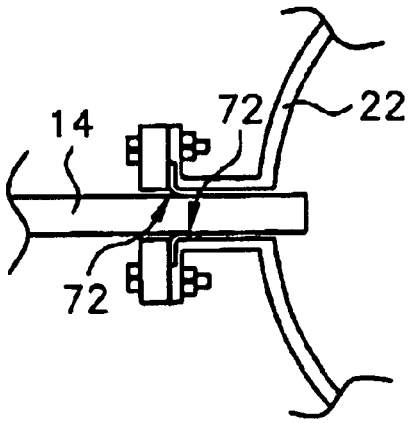
FIG. 2 is a cut-away side sectional view, showing a first pressure vessel of a noise abatement apparatus in relation to a gun muzzle of a gun, taken along cut line 2 of FIG. 1.

According to the present invention, an embodiment of a noise abatement apparatus 20 includes a plurality of pressure vessels, preferably three pressure vessels 22, 24, 26, which are preferably substantially spherical in shape and in alignment with one another. Preferably, the noise abatement apparatus 20 comprises three spherical pressure vessels 22, 24, 26 that are of decreasing size from the entry end of the projectile to the exit end of the projectile. The apparatus 20 also includes legs 28, 30, 32 for mounting each of the pressure vessels 22, 24, 26 on a platform 33.

The noise abatement apparatus 20 can be adapted and sized for a number of different guns 12. In one embodiment, namely, when the noise abatement apparatus 20 is 3 meters in length and weighs approximately 685 kg, the noise abatement system 10 may be used for 25, 35, and 40 mm guns. For such guns, it has been found that the muffler attenuation of a minimum of 12 dBA at a distance of 250 meters all directions from the gun can be achieved. The material of the pressure values may be any known material for this purpose but is preferably carbon steel 517.

In a preferred embodiment of the apparatus 20, the first two pressure vessels 22, 24 ("first" referring to closer to the entry end of the projectile) have internal orifices/baffles, such as those described in U.S. Pat. No. 5,398,589 or U.S. Pat. No. 5,686,688, both of which are incorporated herein by reference. As an example of the internal orifices/baffles, an orifice plate (not shown) may be at about the center of the first pressure vessel 22 which is coupled to the second pressure vessel 24. The orifice plate is an annular disk defining a central circular hole through which the projectile passes. The size of the hole is dictated by the size of the projectile. Also, if the hole is too small, it is difficult to rapidly vent the chamber of the first pressure vessel 22 (or of the second pressure vessel 24) through the hole and out through the port by way of the exhaust blower. On the other hand, if the hole of the orifice plate is too large, the muffling of sound is not sufficient.

As another example of the internal orifices/baffles, the baffles (not shown) are generally conical in shape, having a diameter which linearly decreases from the entry end of the chamber of the first pressure vessel 22 (or the second pressure vessel 24) to the exit end of the chamber of the first pressure vessel 22 (or the second pressure vessel 24). Each baffle may abut against the orifice plate. A retaining wall may be coupled to the chamber of the first pressure vessel 22 (or the second pressure vessel 24), and each orifice plate may be mounted to the retaining wall by way of straps and nuts and bolts. Similar to the orifice plate of the first example, the orifice plate defines a central hole through which a projectile passes. The diameter of the hole is defined by similar functional requirements as the diameter of the hole of the orifice plate of the first example.

Figure 3:
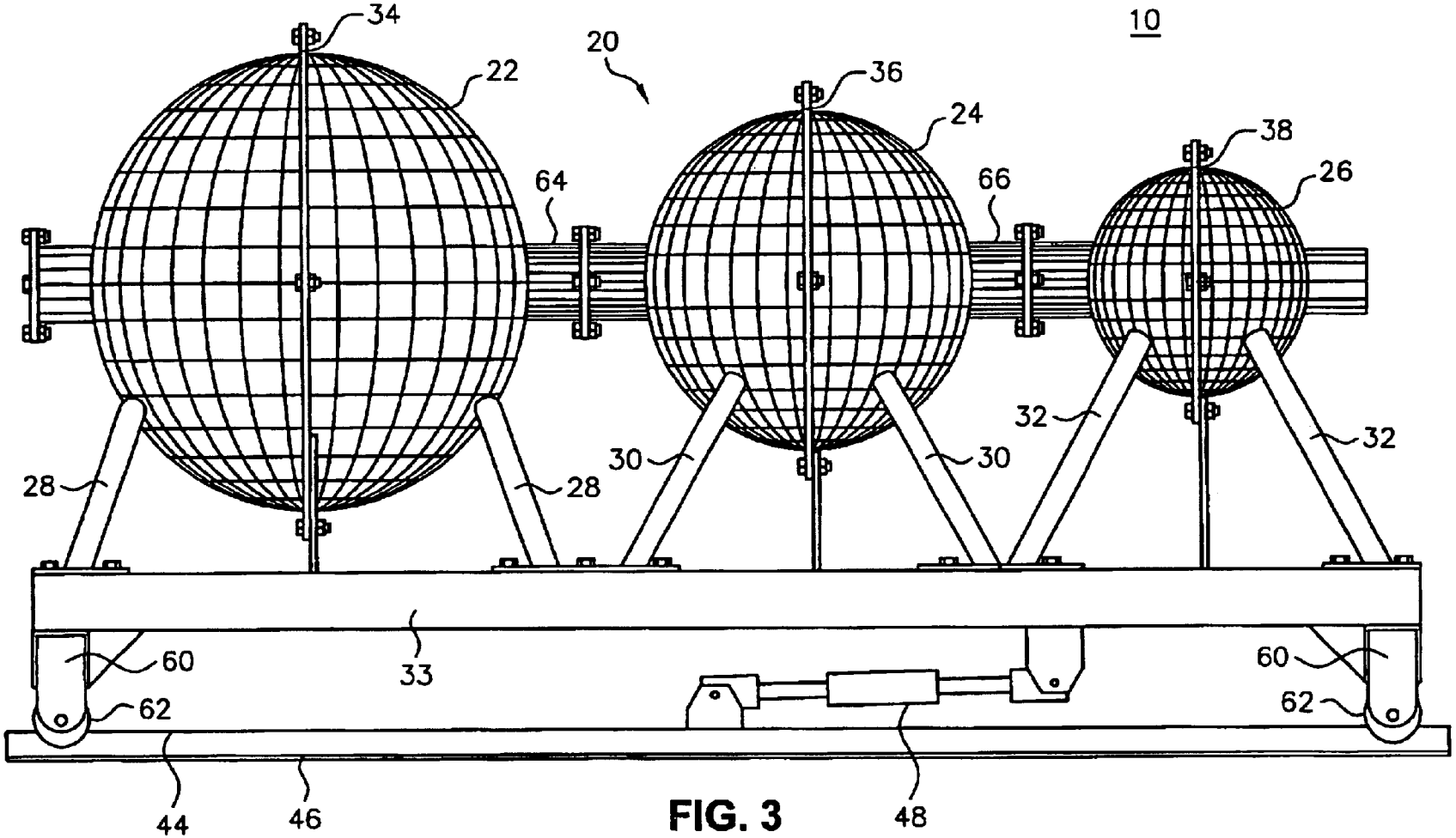
FIG. 3 is a longitudinal side elevational view of an embodiment of a noise abatement apparatus of the present invention mounted on a platform.
Figure 4:
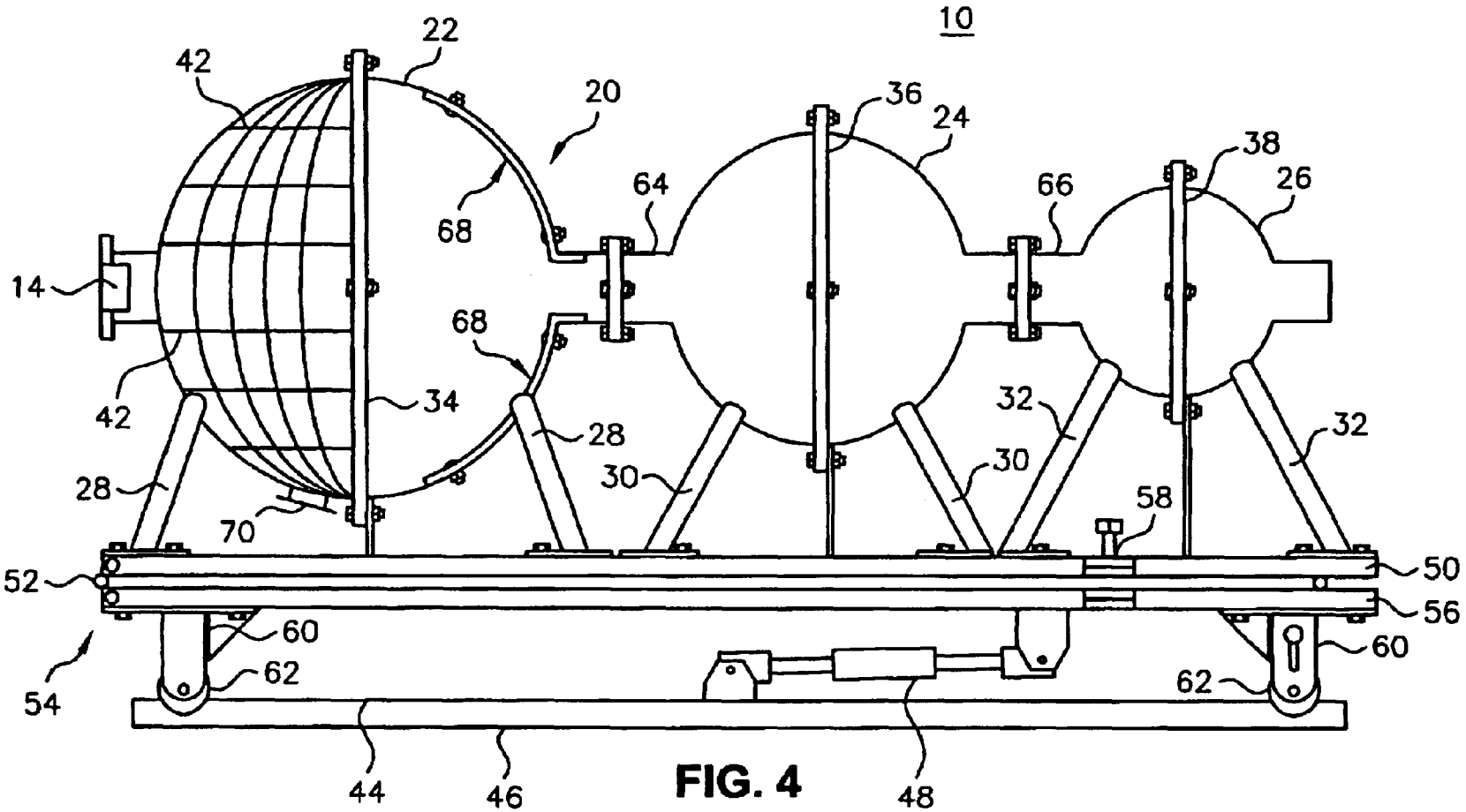
FIG. 4 is a longitudinal side elevational view of the noise abatement apparatus shown in FIG. 3, with at least a portion of the shell of each pressure vessel removed.
Figure 5:
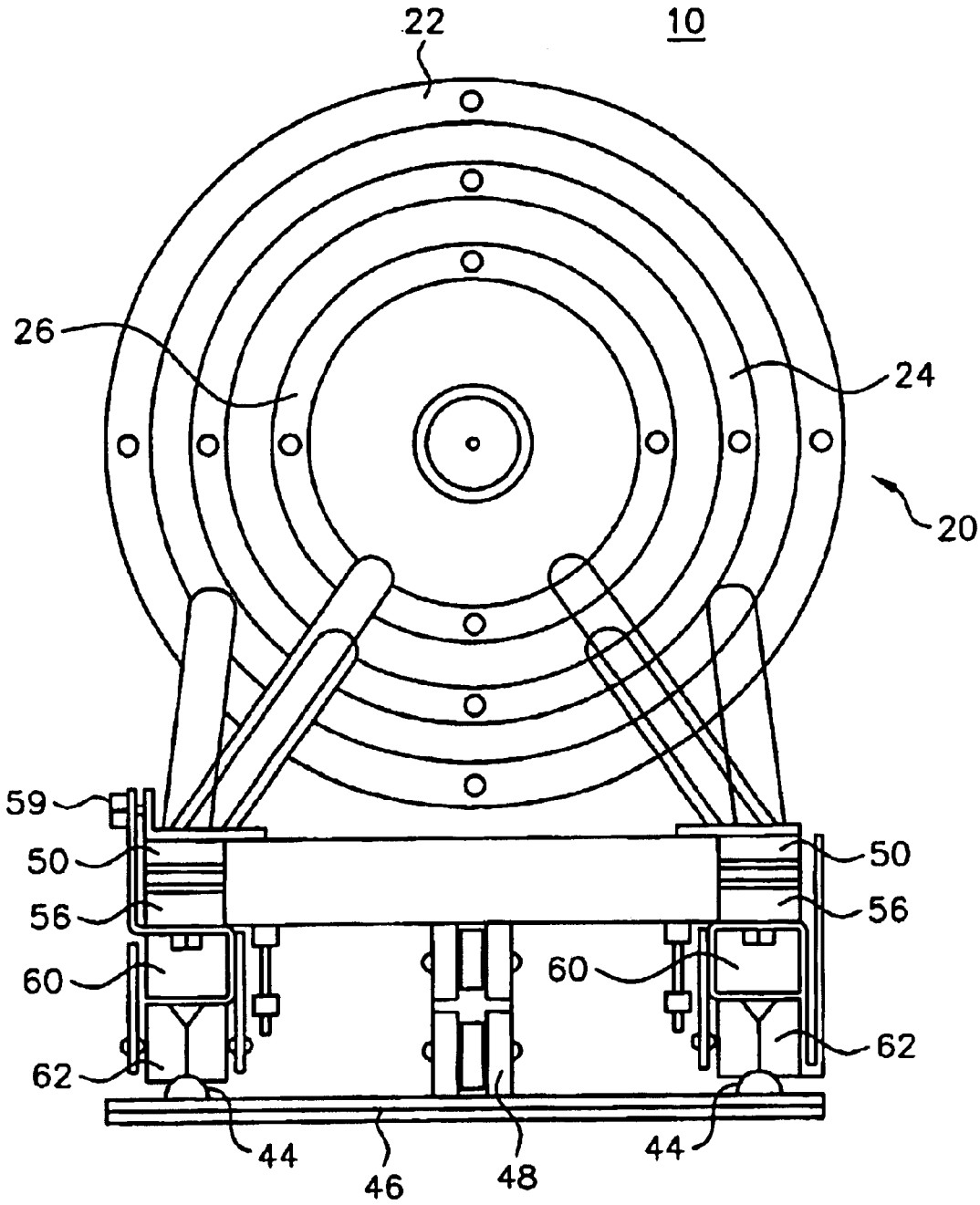
FIG. 5 is an end view of the noise abatement apparatus shown in FIG. 4.
Figure 6:
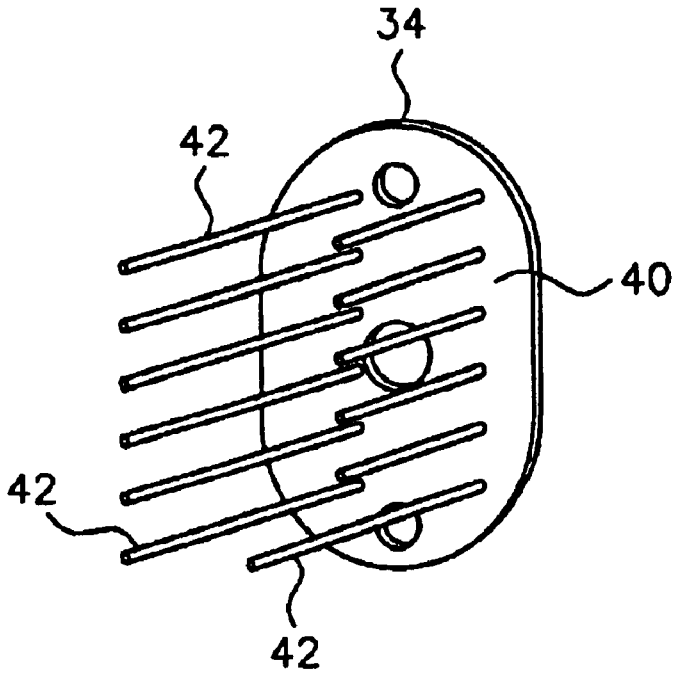
FIG. 6 is an enlarged view of an orifice plate or baffle of the noise abatement apparatus shown in FIG. 4.
Figure 7:
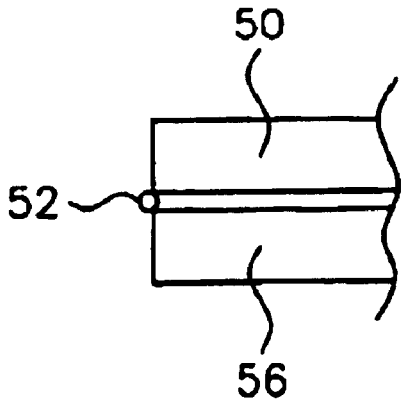
FIG. 7 is an enlarged view of a hinge of the platform shown in FIG. 4.

Alternatively, the baffles 34, 36, 38 may be those shown in FIGS. 3 and 7, namely, consisting of a steel plate 40 (for baffle 34; not shown for baffles 36, 38) with a number of bars 42 (for baffle 34; not shown for baffles 36, 38), such as with twelve bars, welded to the plate. These bars 42 serve to improve the diffusion of the gas from the gun 12. They may either be mounted only to the plate 40 or mounted to the plate 40 at one end and welded to the inside wall of the sphere 22 at their other ends, as shown in FIG. 3.

According to the present invention, an embodiment of a noise abatement system 10 includes the noise abatement apparatus 20 as described above, as well as a track or tracks 44 mounted on a horizontal concrete pad or slab 46 and an actuator 48 for driving the platform 33 along the tracks 44.

The pressure vessels 22, 24, 26 are mounted on the platform 33, which as shown consists of an upper steel frame 50 which is attached preferably by a hinge 52 at the entry end 54 to a lower frame 56. The attachment by the hinge 52 allows for the upper frame 50 to be spaced from the lower frame 56 closer to the exit end of the apparatus 20. This can be achieved by adjusting elevation adjustment 58 or azimuth adjustment 59 as shown by, for example, screws, a jack system, or a hydraulic mechanism (not shown) or some other means. The lower frame 56 has four legs 60 attached, preferably at its corners, with wheels 62 as shown at the lower end of the legs 60. The wheels 62 preferably are grooved and can ride on the steel tracks 44, which itself is attached to the concrete pad or slab 46 embedded in or mounted to the ground. Preferably, the actuator 48 is an electrical actuator, which can be an electric screw jack, may be mounted on the concrete pad or slab 46 and attached to the lower frame 56 to allow for the apparatus 20 to be moved back and forth along the tracks 44.

The pressure vessels 22, 24, 26 can be separated from each other at cylindrical connecting portions 64, 66, which can be bolted together. Preferably, the diameter of each of the connecting portions 64, 66 is greater than the diameter of the gun muzzle 14. In addition, the pressure vessels 22, 24, 26 can be separated from the mounting frame or platform 33 by disconnecting the legs 28, 30, 32 from the upper frame 50, and then completely disassembled by opening them along their halves (as two clam shells) so that they can be easily inspected or repaired, if required. The first pressure vessel 22 incorporates a sabot catcher 68 (namely, a steel plate contoured to the internal wall of the first pressure vessel 22) that can be replaced as required by disassembling the first pressure vessel 22. The first pressure vessel 22 also has an exhaust port 70 with an exhaust blower (not shown) to remove any accumulation of exhaust gas, just as shown and described in U.S. Pat. No. 5,398,589 or U.S. Pat. No. 5,686,688. This can be mounted at any suitable place on the first pressure vessel 22, typically at the top of the vessel 22 with a vent stack (not shown).

The muzzle 14 of the gun 12 being fired projects into the first pressure vessel 22 that incorporates a seal 72 to prevent any gas blowback, while not creating any frictional drag on the recoil of the gun. The seal 72 may have a configuration as shown and described in U.S. Pat. No. 5,398,589 or U.S. Pat. No. 5,686,688 or any other suitable configuration. For example, the seal 72 may be a sliding seal in the form of a lamination, with each layer of the lamination consisting of a material which is rendered flexible by a plurality of radially extending slots, with the slots offset from one another from layer to layer. Different seals will be utilized for various caliber guns being fired.

The electrical actuator 48 moves the cradle on the rail and positions the muzzle 14 of the gun 12 being fired in engagement with the seal 72. The muzzle 14 is made accessible for bore siting by moving the cradle to expose the muzzle 14.

The system and apparatus can be modified by adding any portion or aspect of U.S. Pat. No. 5,398,589 or U.S. Pat. No. 5,686,688 thereto.

What is claimed is:

1. A noise abatement system for a gun having a gun tube, said system comprising:

a platform; and a plurality of generally spherical pressure vessels adapted for attenuating pressure waves caused by a firing of a projectile by the gun and for being mounted on said platform, wherein said plurality of pressure vessels are in general alignment with one another and a first pressure vessel of said plurality of pressure vessels has an end adapted for coupling to the gun tube.

2. The noise abatement system according to claim 1, wherein said platform comprises an upper frame and a lower frame wherein said upper frame is attached to said lower frame by a hinge disposed about said end adapted for coupling to the gun tube.

3. The noise abatement system according to claim 2, further comprising an adjustor for effecting an angular separation between said upper frame and said lower frame about said hinge.

4. The noise abatement system according to claim 2, further comprising a track mounted on a horizontal slab and an actuator for displacing said plurality of pressure vessels along said track, wherein said lower frame comprises a plurality of legs comprising a plurality of wheels adapted for riding on said track.

5. The noise abatement system according to claim 4, wherein said slab is made of concrete.

6. The noise abatement system according to claim 4, wherein said track is made of steel.

7. The noise abatement system according to claim 1, further comprising a track mounted on a horizontal slab and an actuator for displacing said plurality of pressure vessels along said track, wherein said platform comprises a plurality of legs comprising a plurality of wheels adapted for riding on said track.

8. The noise abatement system according to claim 7, wherein said slab is made of concrete.

9. The noise abatement system according to claim 7, wherein said track is made of steel.

10. The noise abatement system according to claim 1, wherein said plurality of pressure vessels is three generally spherical pressure vessels.

11. The noise abatement system according to claim 10, wherein at least two of said three generally spherical pressure vessels are of different sizes.

12. The noise abatement system according to claim 10, wherein said plurality of pressure vessels are of decreasing size in a direction of travel of the projectile.

13. The noise abatement system according to claim 1, wherein said plurality of pressure vessels are mounted on said platform by a plurality of legs.

14. The noise abatement system according to claim 1, wherein said first pressure vessel further has a seal for preventing the escape of residual combustion gases caused by a firing of the projectile by the gun.

15. The noise abatement system according to claim 1, further comprising at least one connecting portion for connecting a pair of said plurality of pressure vessels.

16. The noise abatement system according to claim 1, further comprising a catcher disposed within said plurality of pressure vessels for entrapping particulates and for permitting the projectile to pass.

17. The noise abatement system according to claim 1, further comprising at least one orifice plate being adjustable relative to said plurality of pressure vessels, wherein said orifice plate is disposed in at least one of said plurality of pressure vessels for attenuating pressure waves.

18. The noise abatement system according to claim 17, further comprising a plurality of rods attached to an end of said orifice plate.

19. The noise abatement system according to claim 18, wherein said plurality of rods are further attached to an inside wall of one of said plurality of pressure vessels.

20. A noise abatement apparatus for a gun having a gun tube, said apparatus comprising a plurality of generally spherical pressure vessels adapted for attenuating pressure waves caused by a firing of a projectile by the gun and for being mounted on a surface, wherein at least two of said plurality of pressure vessels are in general alignment with one another and a first pressure vessel of said plurality of pressure vessels has an end adapted for coupling to the gun tube.

21. The noise abatement apparatus according to claim 20, wherein said plurality of pressure vessels is three generally spherical pressure vessels.

22. The noise abatement apparatus according to claim 21, wherein at least two of said three generally spherical pressure vessels are of different sizes.

23. The noise abatement apparatus according to claim 21, wherein said plurality of pressure vessels are of decreasing size in a direction of travel of the projectile.

24. The noise abatement apparatus according to claim 20, wherein said plurality of pressure vessels are mounted on the surface by a plurality of legs.

25. The noise abatement apparatus according to claim 20, further comprising a seal for preventing the escape of residual combustion gases caused by a firing of the projectile by the gun.

26. The noise abatement apparatus according to claim 20, further comprising at least one connecting portion for connecting a pair of said plurality of pressure vessels.

27. The noise abatement apparatus according to claim 20, further comprising a catcher disposed within said plurality of pressure vessels for entrapping particulates and for permitting the projectile to pass.

28. The noise abatement apparatus according to claim 20, further comprising at least one orifice plate being adjustable relative to said plurality of pressure vessels, wherein said orifice plate is disposed in at least one of said plurality of pressure vessels for attenuating pressure waves.

29. The noise abatement apparatus according to claim 28, further comprising a plurality of rods attached to an end of said orifice plate.

30. The noise abatement apparatus according to claim 29, wherein said plurality of rods are further attached to an inside wall of one of said plurality of pressure vessels.

* * * * *